US007204439B2

(12) United States Patent
Fuller

(10) Patent No.: US 7,204,439 B2
(45) Date of Patent: Apr. 17, 2007

(54) APPARATUS AND PROCESS FOR CONTROL OF ROTARY BREAKERS

(76) Inventor: Larry Fuller, 1106 4th St. NW., Reform, AL (US) 35481

( * ) Notice: Subject to any disclaimer, the term of this patent is extended or adjusted under 35 U.S.C. 154(b) by 176 days.

(21) Appl. No.: 10/872,839

(22) Filed: Jun. 21, 2004

(65) Prior Publication Data

US 2005/0279868 A1 Dec. 22, 2005

(51) Int. Cl.

| | |
|---|---|
| ***B02C 17/18*** | (2006.01) |
| ***B02C 17/04*** | (2006.01) |
| ***B02C 23/10*** | (2006.01) |
| *B02C 17/00* | (2006.01) |

(52) U.S. Cl. ..... 241/79.3; 241/34; 241/68; 241/79; 241/79.2; 241/179; 241/181

(58) Field of Classification Search ..... 241/34, 241/68–81, 79.2, 79.3, 176–183, 181
See application file for complete search history.

(56) References Cited

U.S. PATENT DOCUMENTS

| | | | | |
|---|---|---|---|---|
| 2,079,221 | A * | 5/1937 | Miller et al. | 241/80 |
| 3,931,937 | A | 1/1976 | Hahn et al. | |
| 3,934,826 | A | 1/1976 | Graveman | |
| 4,009,834 | A | 3/1977 | Hahn et al. | |
| 4,032,075 | A * | 6/1977 | Tyer, Sr. | 241/45 |
| 4,079,999 | A | 3/1978 | Grimley | |
| 4,219,409 | A | 8/1980 | Liller | |
| 4,281,800 | A * | 8/1981 | Flavel | 241/24.1 |
| 4,322,940 | A | 4/1982 | White | |
| 4,496,083 | A | 1/1985 | Gericke et al. | |
| 4,592,516 | A | 6/1986 | Tschantz | |
| 4,603,814 | A | 8/1986 | Mehltretter et al. | |
| 4,627,576 | A * | 12/1986 | Hahn et al. | 241/24.1 |
| 4,634,060 | A * | 1/1987 | Riemann et al. | 241/74 |
| 4,867,866 | A * | 9/1989 | Mayberry | 209/30 |
| 5,104,048 | A | 4/1992 | Cecil et al. | |
| 6,467,707 | B1 * | 10/2002 | Williams, Jr. | 241/18 |

* cited by examiner

*Primary Examiner*—Lowell A. Larson
*Assistant Examiner*—Jason Y. Pahng
(74) *Attorney, Agent, or Firm*—Adams and Reese LLP

(57) ABSTRACT

Efficient process control of a rotary breaker is dependent upon the rate at which aggregate material is delivered to the rotary breaker. An improved pre-screening apparatus provides enhanced control of the amount of undersized material allowed to bypass the rotary breaker, thus allows some control of feed rate other than the upstream mining conditions. Further, a variable speed drive mechanism allows for enhanced control of the breaking process occurring within the rotary breaker. These improvements allow for the increase in maximum feed rate to an existing rotary breaker or allows for the installation of smaller and more economical original equipment. In addition, an improved discharge mechanism is provided to increase the discharge rates of a breaker without varying size or speed of rotation. These improvements allow for advanced automated process control.

1 Claim, 5 Drawing Sheets

APPARATUS AND PROCESS FOR CONTROL OF ROTARY BREAKERS

FIELD OF THE INVENTION

The present invention relates generally to equipment utilized in the mineral mining and processing industry, and more particularly to devices and methods used to screen and process coal or other similar aggregate materials after being removed from underground mines or strip pits.

BACKGROUND OF THE INVENTION

After removing coal or similar aggregate materials from a mine or strip pit, it is necessary to further process the material, referred to as run-of-mine (ROM) coal, by breaking it, sorting it into certain sizes and removing rock, shale or other impurities. ROM coal is typically delivered to a breaker, which is a large cylindrical shell with interior lifting blades or shelves. The shell of the breaker is perforated with holes to permit passage of small material. The breaker rotates on a horizontal axis, receiving material in one end, tumbling it as it passes thorough the holes in the shell, and permitting the hard, large, unbroken material to pass out the rear of the machine through a discharge spiral or auger. The coal exiting the shell through the holes is processed further, while the large rejected material is hauled away as waste. The "Bradford Breaker" is one example of a commonly used rotary breaker.

Rotary breakers have seen little improvement and undergone few changes since their introduction in the 1870's. While the demand for increased productivity at mining operations continues to grow, designers and manufacturers of these devices have made no large-scale improvements to their design. Typically, the only change in the process made by manufacturers to meet the increasing maximum feed rate demands is simply to increase the size of the apparatus.

As the total amount of material that enters a rotary breaker increases and approaches the design limits of the apparatus, the efficiency of the breaker decreases and allows desirable product to exit the breaker through the spiral discharge at the rear of the machine as waste. To accommodate greater maximum feed rates, the diameter and length of the rotary breaker can be increased. But the increase in maximum feed rate comes at the expense of efficiency at lower feed rates. As the feed rate of material entering the breaker decreases, the material within the breaker is subjected to excessive breakage. Rock and other impurities reach sizes that are permitted to exit the breaker through the holes in the shell rather than through the discharge spiral at the rear of the machine. Further, the coal is also over processed and reduced to undesirable fines.

Accordingly, there is a need for an improved rotary breaker design that not only permits the efficient processing of coal at greater maximum feed rates, but also allows for efficient operation over a wide range of feed rates without sacrificing product quality or increasing the waste of saleable product.

SUMMARY OF THE INVENTION

When a supply of coal, or any other mined material containing rock or other impurities, is introduced into a rotary breaker, a bed of material is formed within the rotating drum. The length, depth and consistency of the bed of material fluctuate with the feed rate and the rate at which processed coal is removed from the drum through the holes in the shell of the drum. Since the rate of processed coal removal is inherently dependant upon the feed rate to the rotary breaker, the only process control variable available to control a conventional rotary breaker is the feed rate of ROM coal. However, feed rate is dependent on upstream mining operations and cannot be economically controlled.

The present invention introduces process control variables that permit efficient operation of the rotary breaker over a wide range of feed rates. A variable pre-screening process is utilized upstream of the rotary breaker. Conventional pre-screening operations, such as fixed, vibratory, and other types of pre-screening systems, employ screening plates containing holes of fixed diameter that permit undersized material to bypass the rotary breaker. ROM coal is delivered to the pre-screening mechanism and deposited onto the plates. The plates may be angled so that the deposited ROM coal is fed into the rotary breaker by gravity. If vibratory screens are employed the vibration of the plates can be used to feed ROM coal to the breaker. Similar to the fixed screens, the vibratory screens may be horizontal or inclined. Besides fixed or vibratory screens, other types of conveyance mechanisms may be employed to deliver the pre-screened ROM coal to the rotary breaker. As the coal passes over the plates, undersized material falls through the holes and bypasses the rotary breaker. The amount of material that bypasses the rotary breaker is a function of the amount of undersized material in the feed; therefore, conventional pre-screening processes do not introduce variables that can be controlled to affect the efficiency of the rotary breaker.

The variable pre-screening apparatus of the present invention, which is described in more detail below, comprises a solid plate section disposed between two screening plate sections. The screening plate sections contain holes that allow undersized material to bypass the rotary breaker. The solid plate section does not contain holes. The variable pre-screening apparatus also comprises a deflector plate capable of being moved into at least two positions, but preferably capable of being controlled over a continuous range of motion. As ROM coal is delivered to the pre-screening apparatus, the ROM coal comes into contact with the deflector plate, which deflects the ROM coal onto the pre-screening apparatus. At times when the feed rate to the breaker is reduced due to upstream mining operations, the deflector plate is retracted out of the path of the ROM coal such that the stream of ROM coal lands upon the solid plate section of the apparatus. Since the solid plate section does not have holes, less material bypasses the breaker and proper bed height, length and consistency can be controlled inside the breaker. Also, as the ROM coal is directed to the solid plate section, the velocity at which it proceeds into the breaker increases, which also allows more undersized material to enter the breaker. Similarly, at times when the feed rate to the breaker increases, the deflector plate is positioned in the path of the ROM coal such that the stream of ROM coal is deflected upon the pre-screening apparatus above the solid plate section. This allows for the immediate removal of undersized material through the first screening plate and reduces the velocity of ROM coal over the remainder of the pre-screening apparatus. By doing so, the maximum amount of material bypasses the rotary breaker, which in turn allows more oversized ROM coal to enter the breaker.

The position of the deflector plate may be controlled manually or automatically. When controlled automatically, the position of the deflector plate can be determined by monitoring process variables that are affected by the feed rate. One such process variable is the electric load on the conveyance mechanism delivering aggregate material to the prescreening apparatus. Another process variable is the electric load on the motor rotating the rotary breaker. Other process variables may also be employed to control the position of the deflector plate.

In addition to controlling the amount of undersized ROM coal entering the rotary breaker, the present invention introduces another process control variable by employing a variable speed motor to turn the breaker. By increasing or decreasing the speed at which the breaker turns, the rate at which oversized ROM coal is broken can be controlled. At times when feed rates are reduced, the breaker can be turned more slowly, which reduces the rate of breakage and the rate at which material leaves the breaker through the holes in the shell. Similarly, at time when feed rates are greater, the breaker can be turned more quickly.

Both the position of the deflector plate on the pre-screening apparatus and the speed of rotation of the rotary breaker can be controlled by employing a programmable logic controller or similar device. Process control variables, such as those described above, may be utilized to control the position of the deflector plate and the speed of rotation. Advanced control schemes may also be employed.

By utilizing these improvements in an existing rotary breaker, the maximum feed rate can be effectively increased. However, the discharge spiral at the rear of an existing rotary breaker may not have sufficient capacity to discharge the required amount of waste at the greater feed rates. Therefore, in addition to the improvements described above, an improved discharge spiral is also disclosed. A conventional discharge spiral operates similar to an auger or screw. The spiral begins along the wall of the rotating drum and lifts material at the rear of the machine toward a central opening. As the drum rotates, the spiral causes the material to move up and closer to the central opening, where it is discharged from the rotary breaker. Because the discharge spiral has fixed dimensions, at a given rate of rotation a fixed amount of material will be discharged from the breaker. At higher feed rates, the capacity of the discharge spiral may be exceeded. Therefore, a multiple-spiral discharge is disclosed that increase the rate of discharge at a given rate of rotation. In addition, the higher feed rates may also cause processed coal that should have been discharged through the holes in the rotary breaker shell to collect at the rear of the machine with the refuse. Thus, the multiple-spiral discharge may further comprise holes or channels that allow processed coal to fall back to the bottom of the drum and prevent processed coal from being discharged with the waste.

By employing the improvements described above, the rotary breaker can be efficiently operated over a wide range of feed rates and in such a manner as to maximize the amount of rock and other refuse rejected, reducing coal, or other material, to the correct size, and maintaining appropriate processed coal quality. This is accomplished by adjusting the appropriate control variables in order to maintain an optimum level of material in the breaker at all times. While the adjustments may be performed manually, a computer, such as a programmable logic controller or similar device, preferably controls the variables.

PREFERRED EMBODIMENTS OF THE INVENTION

In the following detailed description of the preferred embodiments, reference is made to the accompanying drawings, which form a part hereof, and in which are shown by way of illustration specific embodiments in which the invention may be practiced. It is to be understood that other embodiments may be utilized and structural changes may be made without departing from the scope of the present invention.

Figure 1:
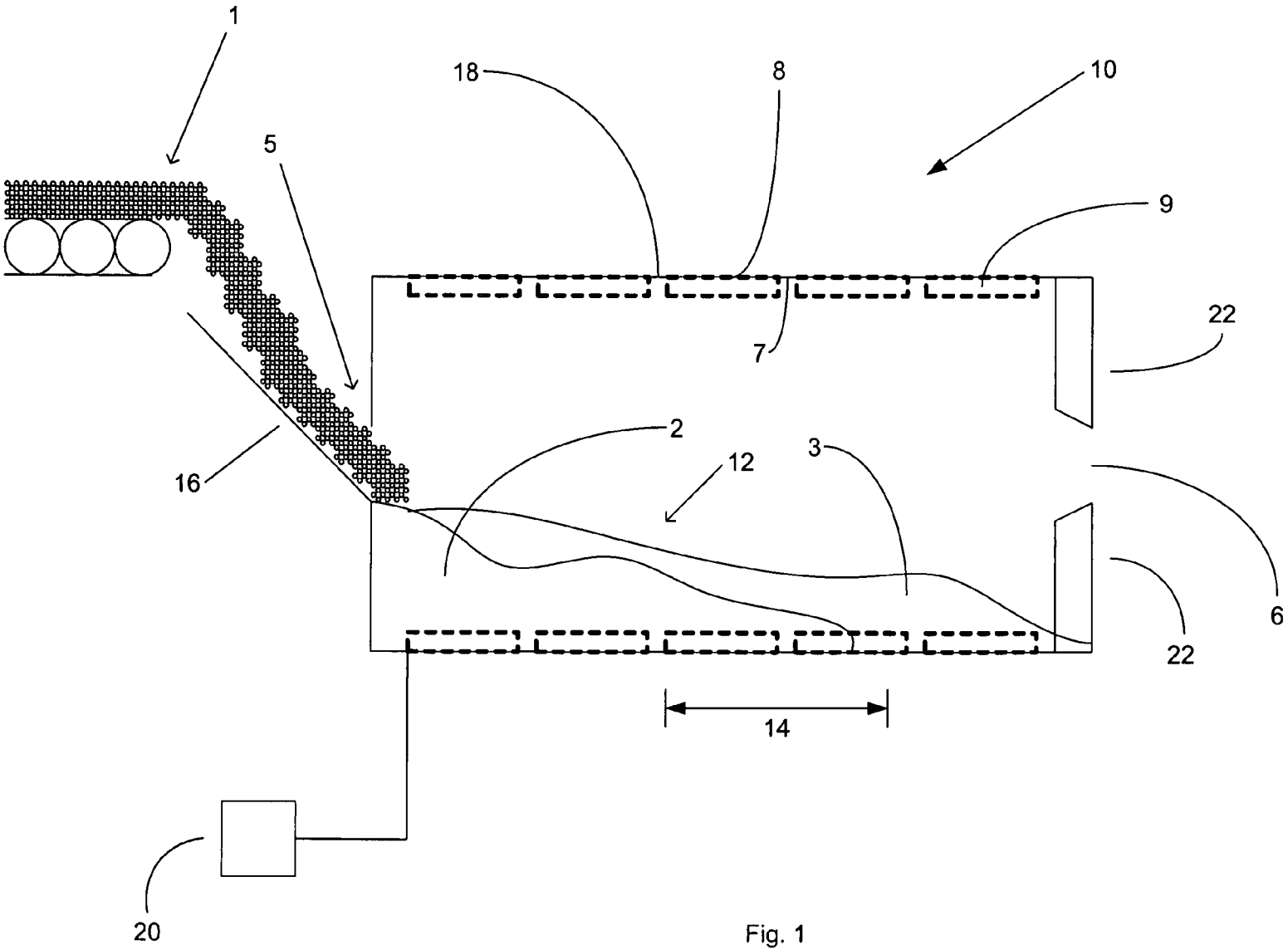
FIG. 1 is a schematic diagram illustrating the operation of a rotary breaker having a material bed of product and waste material.

FIG. 1 is a schematic illustration of the present invention featuring a rotary breaker 10 operating with a material bed 12 having optimum consistency and within an optimum range 14. The material bed 12 contains a level of processed coal 2, which is directed to the walls of the rotary breaker 10 by gravity and the centrifugal force created by the rotating machine, and a level of waste 3, which extends to the rear of the machine. As the processed coal 2 is broken down, the coal 2 works its way between the interstitial spaces of the waste rock 3 and to the walls of the rotary breaker 10. The rotary breaker 10 is comprised of a pre-screening apparatus 16, a hollow rotatable drum 18, a variable speed motor 20, and a multiple-spiral discharge 22. While the multiple-spiral discharge 22 shown in FIG. 1 comprises two discharge spirals, the multiple-spiral discharge 22 may comprise a plurality of discharge spirals. The hollow rotatable drum 18 comprises a first opening 5 to receive aggregate materials 1 from the screening apparatus 16, a second opening 6 to discharge unwanted materials, an interior wall 7 having holes 8 defined therethrough that permit the discharge of processed material of a desired size, and lifting shelves 9 fixedly attached to the interior wall 7. Lifting shelves 9 lift and drop material within drum 18 as it is rotated. The variable speed motor 20 may be a conventional squirrel-cage induction motor or any other drive mechanism capable of turning the drum 18 at variable speeds. The pre-screening apparatus 16 and the variable speed motor 20 may be used separately or together to control the level of the material bed 12. For instance, when feed rates are low and material bed 12 is below the optimum range 14 the variable speed motor 20 can be adjusted to slow the rotation of drum 18 to ensure that material bed 12 stays within the optimum range 14. Also, when feed rates are high and the material bed 12 is above the optimum range 14 pre-screening apparatus 16 can be adjusted to decrease the amount of material entering drum 18 and thereby ensure that the material bed 12 will fall back within the optimum range 14.

Figure 2A:
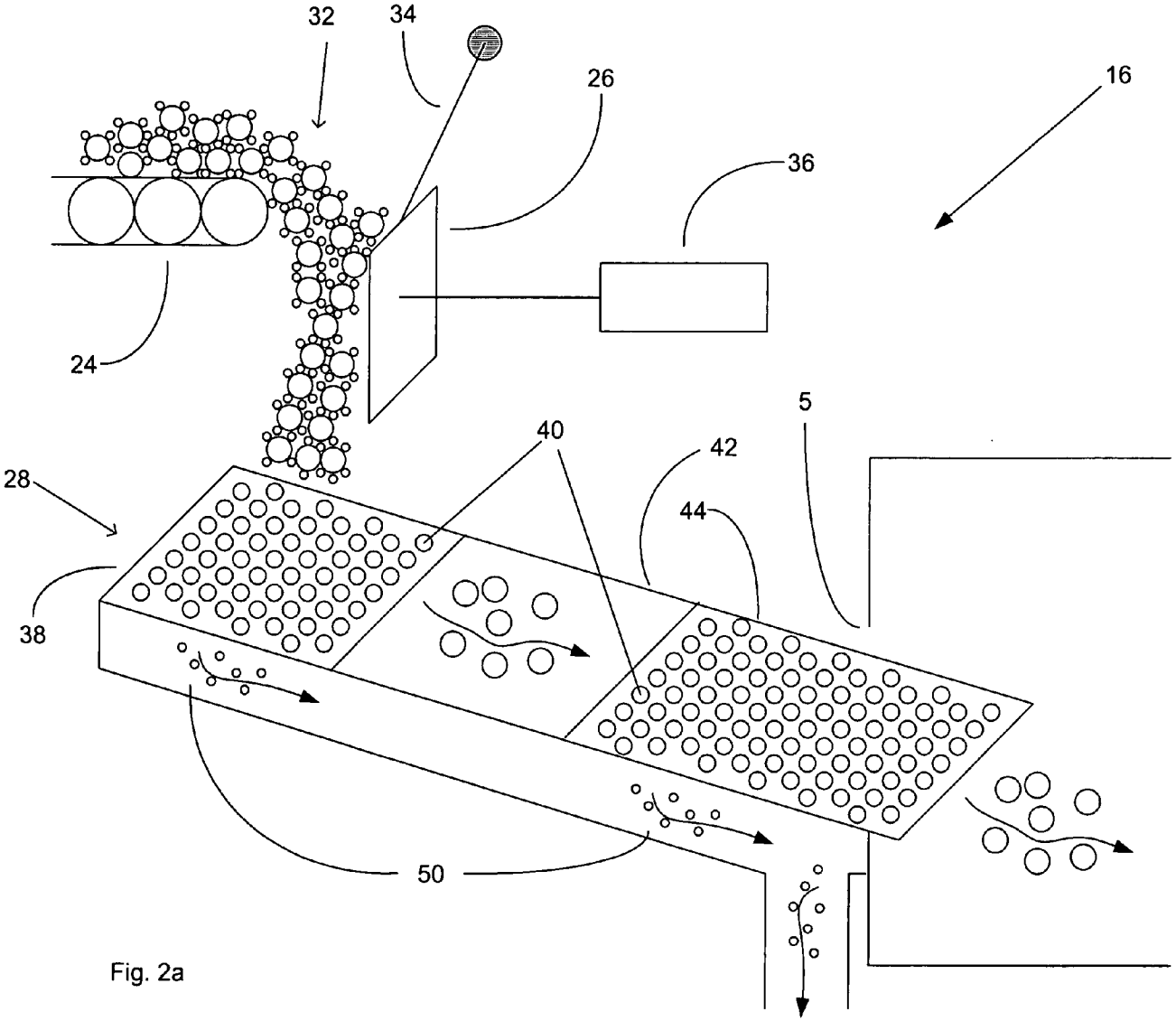
FIG. 2*a* is a schematic diagram of a preferred embodiment of a pre-screening apparatus under high feed rate conditions, featuring a deflector plate, screening surface and rotary breaker.
Figure 2B:
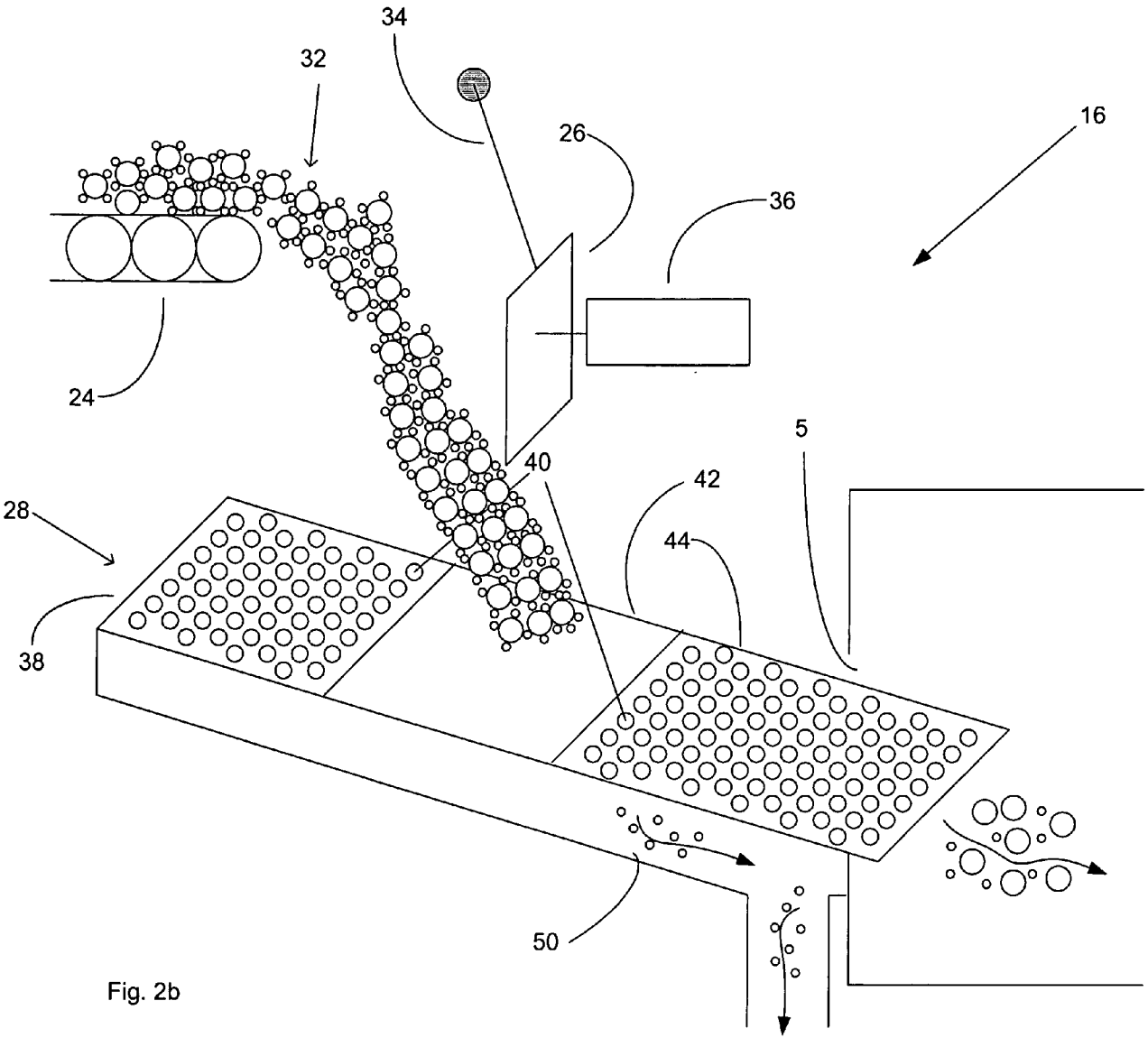
FIG. 2*b* is the apparatus of FIG. 2*a* under low feed rate conditions.

FIGS. 2*a* and 2*b* show one preferred embodiment of the pre-screening apparatus 16 in accordance with the present invention. Pre-screening apparatus 16 is configured with a conveyor mechanism 24, such as a conveyor belt or similar device, a deflector plate 26 and a screening surface 28. The conveyor mechanism 24 moves aggregate materials 32 so that they encounter the deflector plate 26 and/or the screening surface 28. The deflector plate 26 is supported by a support member 34 and moved by an actuator 36 from the position shown in FIG. 2*a*, which corresponds to high feed rate conditions, to the position shown in FIG. 2*b*, which corresponds to low feed rate conditions. In the preferred embodiment, the deflector plate is completely retracted away from the path of the aggregate material during low feed rate conditions. Actuation of the deflector plate 26 may be accomplished by any conventional means, but is preferably a pneumatic, hydraulic, or similar type actuator. While FIGS. 2*a* and 2*b* illustrate the actuation of the deflector plate 26 in either one of two positions, deflector plate 36 may also be continuously controlled over its entire range of motion, which allows for a greater level of process control. The screening surface 28 may be in a flat or inclined position and comprises a first screening plate section 38 with holes 40, a solid plate section 42 and a second screening plate section 44 with holes 40. The solid plate section 42 is located between the first screening plate section 38 and the second screening plate section 44. The aggregate materials 32 are generally delivered from the conveyor mechanism 24 onto the screening surface 28. When the rotary breaker 10 requires additional material to maintain the material bed in the optimum range, the actuator 36 moves the deflector plate 26 into the position shown in FIG. 2*b*, which allows the aggregate materials 32 to impact the solid plate section 42, whereby the aggregate materials 32 are rapidly introduced into the rotary breaker 10 through opening 5 with minimal screening. As shown in FIG. 2*b*, first screening plate 38 is bypassed and the velocity at which the material flows over the second screening plate 44 is greater. Thus, while a portion of undersized material continues to fall through screening surface 28, a portion of undersized material is also allowed to enter the rotary breaker 10. When the rotary breaker 10 requires less material to maintain the material bed within the optimum range the actuator 36 moves deflector plate 26 into the position shown in FIG. 2*a*, which causes the aggregate materials 32 to impact the deflector plate 26 and is directed onto the first screening plate section 38. The holes 40 located in the first screening plate sections 38 allow undersized material 50 to fall through. The remaining aggregate materials 32 flow over the second screening plate section 44 where additional screening takes place allowing for maximum removal of the undersized material 50. The remaining material then enters opening 5 of the rotary breaker 10. The pre-screening application shown in FIGS. 2*a* and 2*b* is adaptable to fixed, vibratory, or other types of screening methods and apparatuses.

If the pre-screening apparatus 16 is employed in the absence of a variable speed motor 20, the electric load of the constant speed motor may be employed to control the position of the deflector plate 26. In one preferred embodiment, the electric load on the constant speed motor is continuously monitored. As the feed rate to the rotary breaker increases, the electric load on the motor turning the breaker also increases. When the load on the motor increases beyond a predetermined value, the actuator moves the deflector plate into the position illustrated in FIG. 2*a*, thereby increasing the amount of material bypassing the breaker resulting in a decrease in the load on the electric motor. As the feed rate to the breaker decreases, the load on the motor also decreases. Once the load decreases below a predetermined value, the actuator moves the deflector plate into the position illustrated in FIG. 2*b*, thereby decreasing the amount of material bypassing the breaker and resulting in an increase in the motor load. In one preferred embodiment, the process control method described above is employed to maintain the electric load on the constant speed motor in the range of about 70 to about 85% of maximum electrical load. Maintaining this preferred range ensures that the material bed in the breaker is within its optimum range. However, it is understood that factors, such as the material being processed and the particular type of equipment being used, could increase or decrease this range.

If the pre-screening apparatus is employed in conjunction with a variable speed motor, a similar process control scheme may be employed. In another preferred embodiment, the electric load on the variable speed motor is continuously monitored, along with the rotational speed of the motor. As the feed rate to the rotary breaker increases, the electric load on the motor turning the breaker also increases. When the load on the motor increases beyond a predetermined value, the actuator moves the deflector plate into the position illustrated in FIG. 2*a*, thereby increasing the amount of material bypassing the breaker resulting in a decrease in the load on the electric motor. If the electric load on the motor does not decrease, the speed on the variable speed motor can then be increased in order to more efficiently process the higher feed rate of material to the breaker. As the feed rate to the breaker decreases, the load on the motor also decreases. Once the load decreases below a predetermined value, the actuator moves the deflector plate into the position illustrated in FIG. 2*b*, thereby decreasing the amount of material bypassing the breaker and resulting in an increase in the motor load. If the electric load on the motor does not increase, the speed on the variable speed motor can then be decreased in order to more efficiently process the lower feed rate of material to the breaker. As with the constant-speed motor, it is preferred range of operation for the electric load on the variable speed motor is about 70 to about 85% of maximum electrical load. As before, factors, such as the material being processed and the particular type of equipment being used, could increase or decrease this range.

Figure 3A:
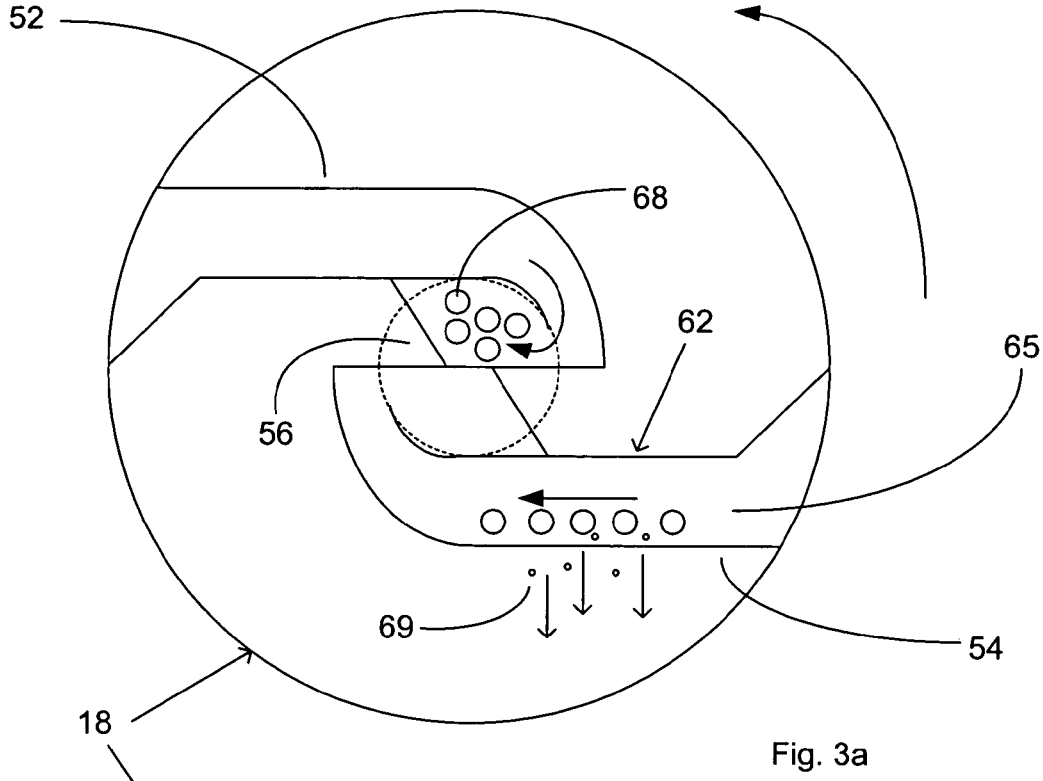
FIGS. 3*a* and 3*b* are perspective views from inside and to the rear of a rotary breaker, featuring a multiple discharge spiral.
Figure 3B:
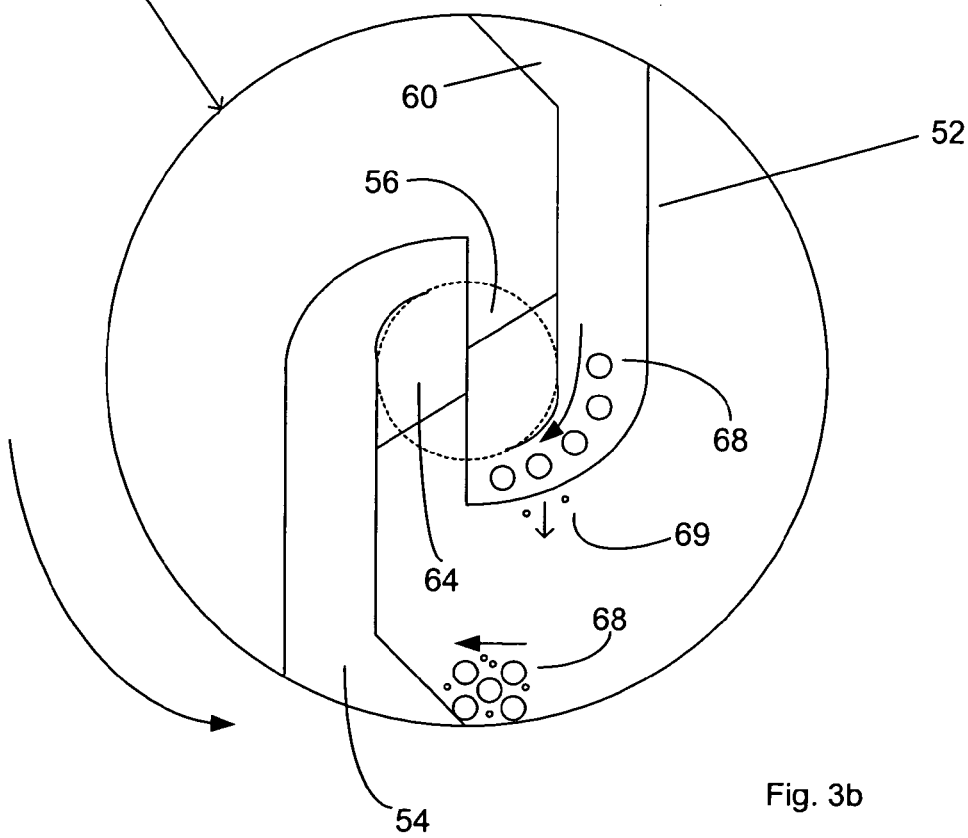

FIGS. 3*a* and 3*b* show a multiple-spiral discharge 22 in accordance with the present invention. The multiple-spiral discharge 22 is configured with an upper spiral discharge 52 and a lower spiral discharge 54. Both the upper spiral discharge 52 and the lower spiral discharge 54 eliminate unwanted materials out of the second opening 56 of the rotary breaker 10. The second opening 56 forms a central circular hole in the discharge end of the drum 18 where unwanted material leaves the rotary breaker 10. The upper spiral discharge 52 and lower spiral discharge 54 are located approximately 180 degrees from each other relative to the centerline axis of the hollow rotatable drum 18. The upper spiral discharge 52 is configured identically to the lower spiral discharge 54; each contains a scoop plate 60, multiple chute plates 62, and a discharge plate 64. The scoop plates 60, the chute plates 62 and the discharge plates 64 are fixedly attached together (bolted, welded, etc.) to form the upper discharge spiral 52 and the lower discharge spiral 54. Bolting of the scoop plates 60, the chute plates 62 and the discharge plates 64 allow for removal of the individual plates after wear occurs. When viewed proximally, the scoop plates 60, the chute plates 62, and the discharge plates 64 form an inclined surface that extends from the wall of the drum 18 to the discharge opening 56. The plates 60, 62, 64 are also attached at an incline to the rear of the rotary breaker to form a trough 65 that contains the waste material 68. As the drum 18 rotates around its horizontal axis, waste material is picked up by scoop plates 60 then travels along chute plates 62, along which the waste material travels up and toward central opening 56. Discharge plates 64 allow the waste material to fall out of discharge opening 56.

FIGS. 3*a* and 3*b* also shows a preferred embodiment of the plate members of the multiple-spiral discharge 22. As shown in the figures, the scoop plates 60, the chute plates 62 and the discharge plates 64, comprise a plurality of holes (not shown) to allow for further separation of desired product 69 from unwanted material 68. As the discharge spirals 52, 54 rotate, the relatively smaller desired products 69 flow over the plates 60, 62, 64 and fall through the holes, whereas the relatively larger waste material 68 follows the discharge spiral 52, 54 into the discharge opening 56. In addition to holes, other types of non-solid surface may be employed when manufacturing scoop plates 60, chute plates 62 and discharge plates 64, such as railed, grate or mesh type surfaces.

Figure 4:
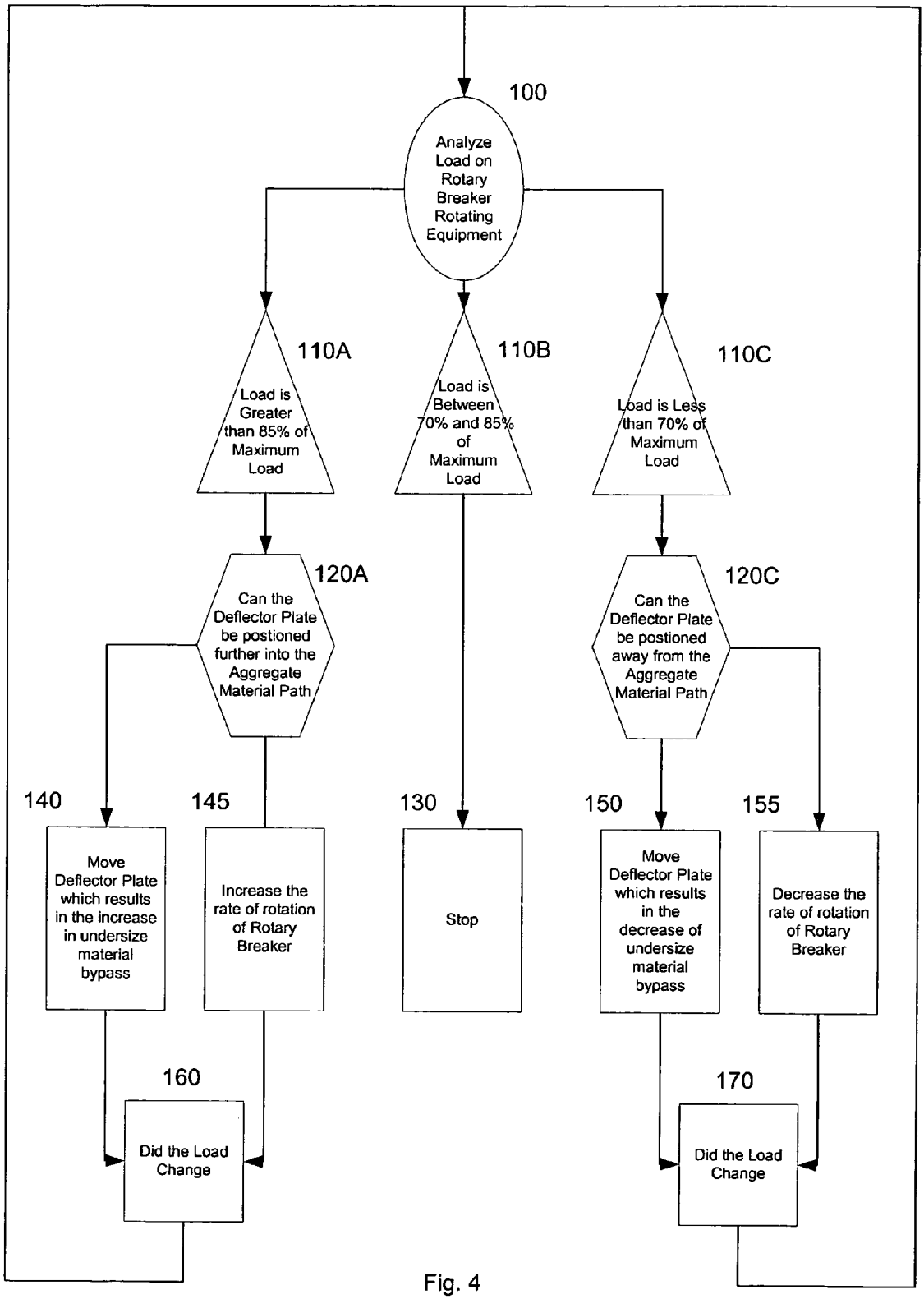
FIG. 4 is a block diagram illustrating one preferred method of process control featuring both a pre-screening apparatus and a variable speed drive mechanism.

FIG. 4 illustrates one preferred method of process control featuring both a pre-screening apparatus and a variable speed drive mechanism. The drive mechanism may be any type of rotating equipment, however, it is preferably an electric motor. As designated by Block 100, the load on the electric motor is continuously monitored. This monitoring function may be performed by an individual if the system is manually controlled, or if the system is automatically controlled, a signal corresponding to the electrical load may be sent to a programmable logic controller (PLC) or similar device. The action taken by the individual or PLC is dependant upon the value of the electrical load. If the load is greater than 85% of the motor's rated maximum load, designated by Block 110A, the position of the deflector plate is determined, designated by Block 120A. If the deflector plate can be moved into, or further into, the path of the aggregate material, Block 140, then the deflector is moved, which results in an increase in the amount of material bypassing the rotary breaker. If the deflector plate cannot be moved further into the path of the aggregate material because it has reached the end of its range of motion, the rate of rotation of the rotary breaker is increased, Block 145. Similarly, if the load is less than 70% of the motor's rated maximum load, designated by Block 110C, the position of the deflector plate is determined, designated by Block 120C. If the deflector plate can be moved further away from the path of the aggregate material, Block 150, then the deflector is moved, which results in a decrease in the amount of material bypassing the rotary breaker. If the deflector plate cannot be moved further away from the path of the aggregate material because it has reached the end of its range of motion, the rate of rotation of the rotary breaker is decreased, Block 155. After every movement of the deflector plate and change in speed of rotation, the load is again analyzed, 160, 170, to determine if another control step is required.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. An apparatus for processing aggregate materials containing a desired product and a waste product, the apparatus comprising:

(a) a rotary breaker comprising a hollow cylinder having a horizontal axis, a first opening defined through one end of the hollow cylinder for receiving the aggregate material, a second opening defined through the opposite end of the hollow cylinder for discharging the waste product, an interior wall having a plurality of lifting members capable of lifting and dropping the aggregate material as the rotary breaker rotates around the horizontal axis, a discharge mechanism capable of lifting the waste product from the hollow cylinder and rejecting the waste product through the second opening, and a variable speed drive mechanism capable of turning the rotary breaker at variable speeds; wherein the discharge mechanism further comprises a plurality of inclined surfaces capable of rejecting the waste product from inside the hollow cylinder and through the second opening as the hollow cylinder rotates around its horizontal axis;

(b) a screening apparatus having a screening surface directing aggregate material into the first opening in the rotary breaker, wherein the screening surface further comprises a first screening section having a plurality of holes defined therethrough, a second screening section having a plurality of holes defined therethrough, and a solid plate section disposed between the first and second screening sections; means for conveying aggregate material to the screening surface, a deflector plate positioned proximate to the means for conveying such that the aggregate material is capable of impacting the deflector plate before being delivered to the screening surface, and actuation means attached to the deflector plate capable of moving through a range of motion and capable of positioning the deflector plate such that at one end of the range of motion the aggregate material lands on the first screening section and at the other end of the range of motion the aggregate material lands on the solid plate section; and (c) means for controlling the position of the deflector plate through its entire range of motion, wherein said means for controlling the position of the deflector plate utilizes an electrical load on the variable speed drive mechanism to determine the position of the deflector plate.

* * * * *